US006583541B1

(12) United States Patent
Ueshima et al.

(10) Patent No.: US 6,583,541 B1
(45) Date of Patent: Jun. 24, 2003

(54) FILAMENT LAMP WITH PINCH-SEALED BASE PLATE-SHAPED TERMINALS CONNECTING AN OUTER LEAD TO A FEED LINE

(75) Inventors: Yukio Ueshima, Himeji (JP); Tooru Odagaki, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/438,582

(22) Filed: Nov. 12, 1999

(30) Foreign Application Priority Data

Nov. 12, 1998 (JP) ..... 10-321565

(51) Int. Cl.[7] ..... H01J 5/48; H01J 5/50

(52) U.S. Cl. ..... 313/318.01; 313/318.07; 313/318.09; 313/624; 313/623; 439/611; 439/612

(58) Field of Search ..... 313/318.01, 318.02, 313/318.07, 318.08, 318.09, 318.1, 623, 624; 439/611, 612

(56) References Cited

U.S. PATENT DOCUMENTS 5,001,388 A * 3/1991 Janssen et al. ..... 313/318.02

5,241,239 A * 8/1993 Rao ..... 313/318.02

FOREIGN PATENT DOCUMENTS

EP 821 398 A2 * 10/1997 ..... H01J/61/36
JP Hei 5-41203 2/1993

* cited by examiner

*Primary Examiner*—Ashok Patel
*Assistant Examiner*—Mariceli Santiago
(74) *Attorney, Agent, or Firm*—Nixon Peabody LLP; David S. Safran

(57) ABSTRACT

A filament lamp with bases in which the pinch seal areas are not damaged and no adhesive is used is achieved by the base of a filament lamp with bases having, in its front area, a holding part for holding a pinch seal area and a first opening into which an outer lead pin is inserted, and in its rear area, a second opening into which a plate-shaped terminal is inserted. Furthermore, the base has another opening, between the first opening and the second opening, which is used to weld the outer lead pin to plate-shaped terminal in a direction which orthogonally intersects the lengthwise direction of the base and orthogonally intersects the wider crimped foot surface of the pinch seal area. The plate-shaped terminal has a size such that it does not fall out of the second opening of the base. The terminal is welded to the outer lead pin such that its flat surface is parallel to the pinch seal area.

2 Claims, 5 Drawing Sheets

FILAMENT LAMP WITH PINCH-SEALED BASE PLATE-SHAPED TERMINALS CONNECTING AN OUTER LEAD TO A FEED LINE

BACKGROUND OF THE INVENTION

1. Field of the Invention

The invention relates to a filament lamp with bases. In particular, the invention relates especially to a filament lamp with bases in which, in a pinch seal area, a base composed of a ceramic is attached to each of two ends of a tubular bulb without using an adhesive.

2. Description of Related Art

Filament lamps with bases are known in which no adhesive is used at locations at which an outer lead extends from an end of the lamp and a feed line from a power source or the like are welded to one another. This lamp has an arrangement in which, in a plate-shaped terminal, the respective outer lead which projects out of the respective pinch seal area on the two ends of the tubular bulb is welded to the tip of the feed line and these weld points are protected by ceramic bases.

FIGS. 6 and 7 schematically show one such filament lamp with bases. FIG. 6 shows a perspective view of only one end of a filament lamp with bases. FIG. 7 shows a cross section of the end of the filament lamp with bases as shown in FIG. 6, the lamp being viewed from the direction of a through opening 92 which is located in a base 70. The lamp has a bulb 1, with a flattened pinch seal area 2 which is located on each of two ends of the bulb 1, a molybdenum foil 3, a filament 4, a supporter 5 for holding the filament, an outer lead 6 with one end connected to the molybdenum foil 3 and its other end extending from the pinch seal area 2, and a ceramic base 70.

As is shown in FIG. 7, the base 70 has a concave holding part 71 on one end to hold the pinch seal area 2. The outer lead 6 which extends from the pinch seal area 2 is inserted into a first opening 90 which is located in the bottom of the holding part 71. On the other end of the base 70, a second opening 91 is formed into which a feed line 81 is inserted which is connected to a power source or the like. A plate-shaped terminal 8 is attached to the tip of this feed line 81. This terminal 8 and the outer lead 6 are electrically connected to one another by welding.

Between the first opening 90 and the second opening 91, a through opening 92 is formed in the direction which orthogonally intersects the lengthwise direction of the base 70 and a welding rod (not shown) is inserted into the through opening from its two ends. Thus, the location at which the terminal 8 and the outer lead 6 are in contact with one another is welded. As a result, in the pinch seal area 2, an electrical connection is enabled without using adhesive.

In one such conventional filament lamp with bases, however, there was the following disadvantage:

The direction of the pinch seal area 2 which is held in the holding part 71 of the base 70 and the direction of the plate-shaped terminal 8 are hardly considered. If, in the direction in which the wider crimped foot surface 2A of the pinch seal area 2 and a flat plane 8A of the plate-shaped terminal 8 intersect orthogonally, welding is performed, a stress is applied to the terminal 8 in the directions of the arrows shown in FIG. 7 and this stress is transferred to the outer lead 6; this leads to fracturing of the pinch seal area 2.

The plate-shaped terminal 8 can absorb stress by bending when the stress is applied from a direction which orthogonally intersects the plane 8A. However, the terminal 8 cannot absorb stress when the stress is applied from a direction parallel to the plane 8A (i.e., in the directions of the arrows shown in FIG. 7). This stress is transferred directly to the outer lead 6. Since the pinch seal area 2 has a flattened shape and is weak against stress in the direction which orthogonally intersects the wider crimped foot surface 2A, it is therefore damaged by the stress transferred to the outer lead 6.

If, between the holding part 71 of the base 70 and the pinch seal area 2, there is a large gap, the pinch seal area 2 is tilted within the holding part 71. If it is extremely tilted, the peripheral edge area A of the first opening 90 of the base 70 borders the outer lead 6. This border point functions as an articulation point and the outer lead 6 is exposed to a stress. When this stress is exerted in a direction which orthogonally intersects the wider crimped foot surface 2A of the pinch seal area 2, for the above described reason, there is the disadvantage that the pinch seal area 2 is damaged.

SUMMARY OF THE INVENTION

The invention was devised to eliminate the above described disadvantage in the prior art. Therefore, a primary object of the invention is to devise a filament lamp with bases in which the pinch seal areas are not damaged and no adhesive is used.

The above object is achieved in accordance with the invention in a filament lamp with bases which comprises:

- a tubular bulb with a flattened pinch seal area formed on each of its two ends;
- a filament which is located within the bulb along the longitudinal axis;
- outer leads which are electrically connected to the filaments and which project out of the pinch seal area; and
- bases of ceramic for protection of the plate-shaped terminals which electrically connect the outer leads to the feed lines, by
- the respective ceramic base on one side being provided with a concave holding part for holding of the pinch seal area and a first opening into which the outer lead which is located in the holding part is inserted, and the respective base on the other side has a second opening into which the plate-shaped terminal is inserted,
- an opening being provided between the first opening and the second opening which is used to weld the outer lead and the plate-shaped terminal to one another in a direction which orthogonally intersects the lengthwise direction of the base and orthogonally intersects the wider crimped foot surface of the pinch seal area in the holding part,
- the respective plate-shaped terminal being larger than the first opening of the base and being welded to the outer terminal such that its flat plane is parallel to the wider crimped foot surface of the pinch seal area.

Furthermore, the object is achieved according to the invention by the holding part of the respective base essentially having the same shape as that of the accommodated pinch seal area, and the distance between the side of the pinch seal area from which the outer lead does not project and the inside of the holding part which is opposite this side is smaller than the distance between the outer lead which penetrates the first opening of the base and the peripheral edge area of this opening.

In the following, the invention is specifically described using an embodiment shown in the drawings.

DETAILED DESCRIPTION OF THE INVENTION

Figure 1:
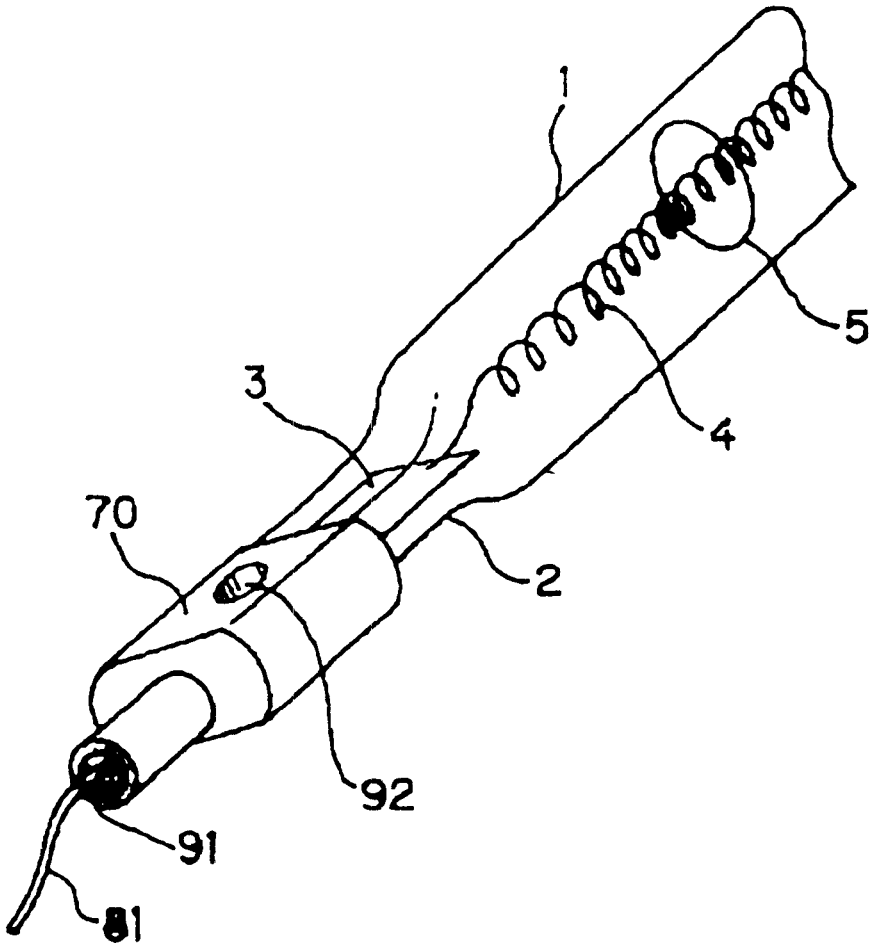
FIG. 1 is a perspective view of one end of a filament lamp with bases according to one embodiment of the invention.
Figure 2:
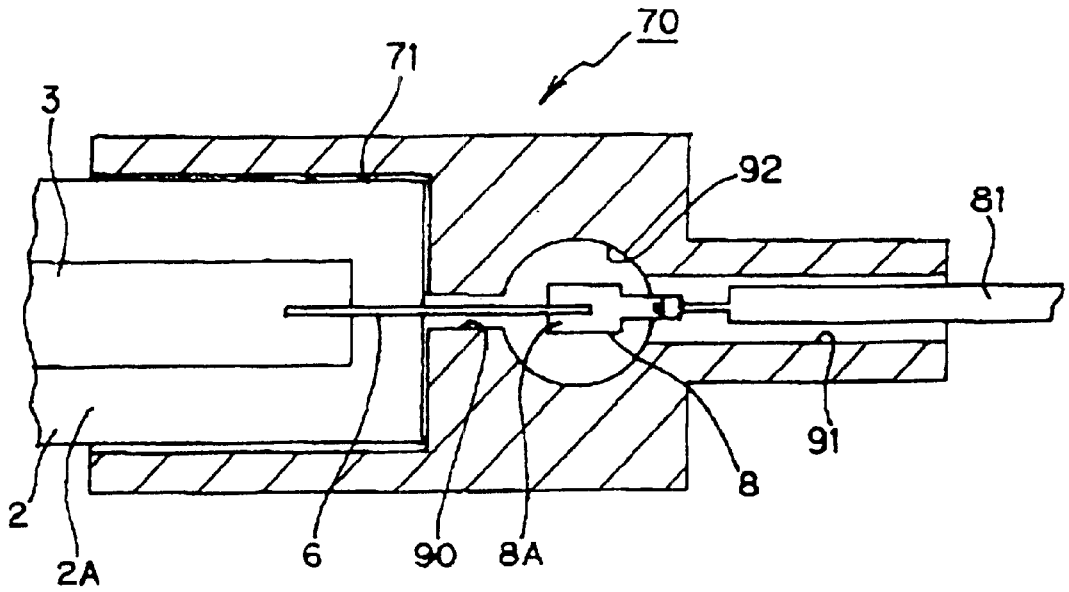
FIG. 2 is a cross-sectional view of the end of the filament lamp with bases according to FIG. 1 taken in a plane which is perpendicular the lengthwise direction of the through opening.

FIG. 1 shows one end of a filament lamp which has bases according to one embodiment of the invention, it being understood that the unillustrated, opposite end is constructed in a like manner. The tubular filament lamp comprises a bulb 1, on each end of which a flattened pinch seal area 2 is formed, a molybdenum foil 3, a filament 4, a supporter 5 for holding the filament, and an outer lead 6 with one end connected to the molybdenum foil 3 and its other end extended from the pinch seal area 2, a base 70, and a plate-shaped terminal 8 which is attached to the tip of a feed line 81 by caulking or similar methods.

The base 70 has a concave holding part 71, a first opening 90, a second opening 91 and a through opening 92. The holding part 71 holds the pinch seal area 2. The first opening 90 is located in the bottom of the holding part 71. The outer lead 6, which extends from the pinch seal area 2, is inserted into the first opening 90 and routed to the through opening 92. The plate-shaped terminal 8 and the feed line 81 are partially inserted into the second opening and are routed to the through opening 92. The through opening 92 is located between the first opening 90 and the second opening 91. It extends in a direction which orthogonally intersects the lengthwise direction of the base 70 and the crimped foot surface 2A of the pinch seal area 2.

Since, during operation of the filament lamp, this base 70 has a high temperature of roughly 200° C. to 300° C., it is made of a ceramic with heat resistance temperature of at least 400° C.

In the following, a state is described in which the base 70 is attached in the pinch seal area 2 without adhesive. In the base 70, the area in which the holding part 71 is formed has a rectangular shape. The area which adjoins this area and in which the second opening 91 is formed to hold the feed line 81 has a cylindrical shape. The base 70 is made overall such that it extends in the axial direction of the tube of the filament lamp.

In the rectangular shaped area of the base 70, the through opening 92 is formed in the direction which orthogonally intersects the lengthwise direction of the base and the wider crimped foot surface 2A of the pinch seal area which is held in the holding part 71.

Figure 4:
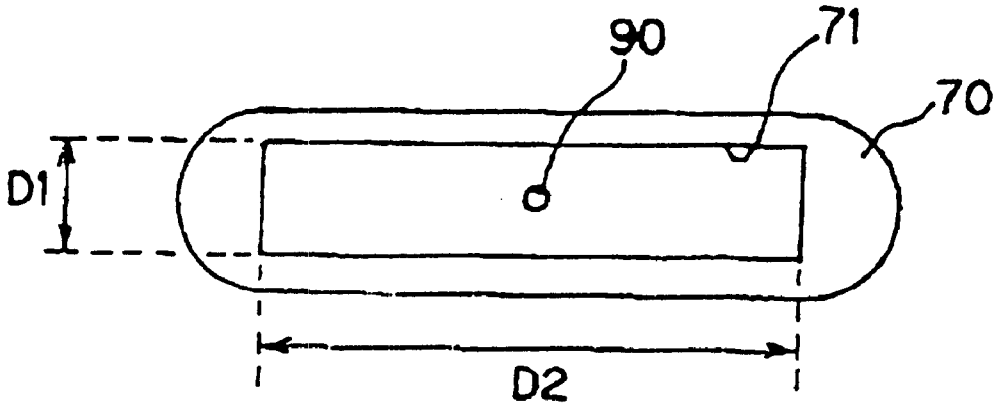
FIG. 4 is a front view of the base in a direction facing the holding part in the filament lamp with bases.

FIG. 4 shows the shape of the holding part 71. The height D1 is 3.6 mm, the width D2 is 11.4 mm and the slot distance in the lengthwise direction of the base 70 is 7.00 mm.

Figure 5:
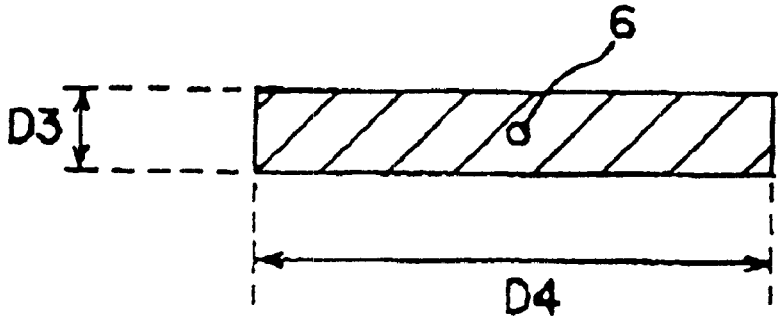
FIG. 5 is a cross section of the pinch seal area which is inserted into the holding part of the filament lamp with bases in accordance with the invention.
Figure 6:
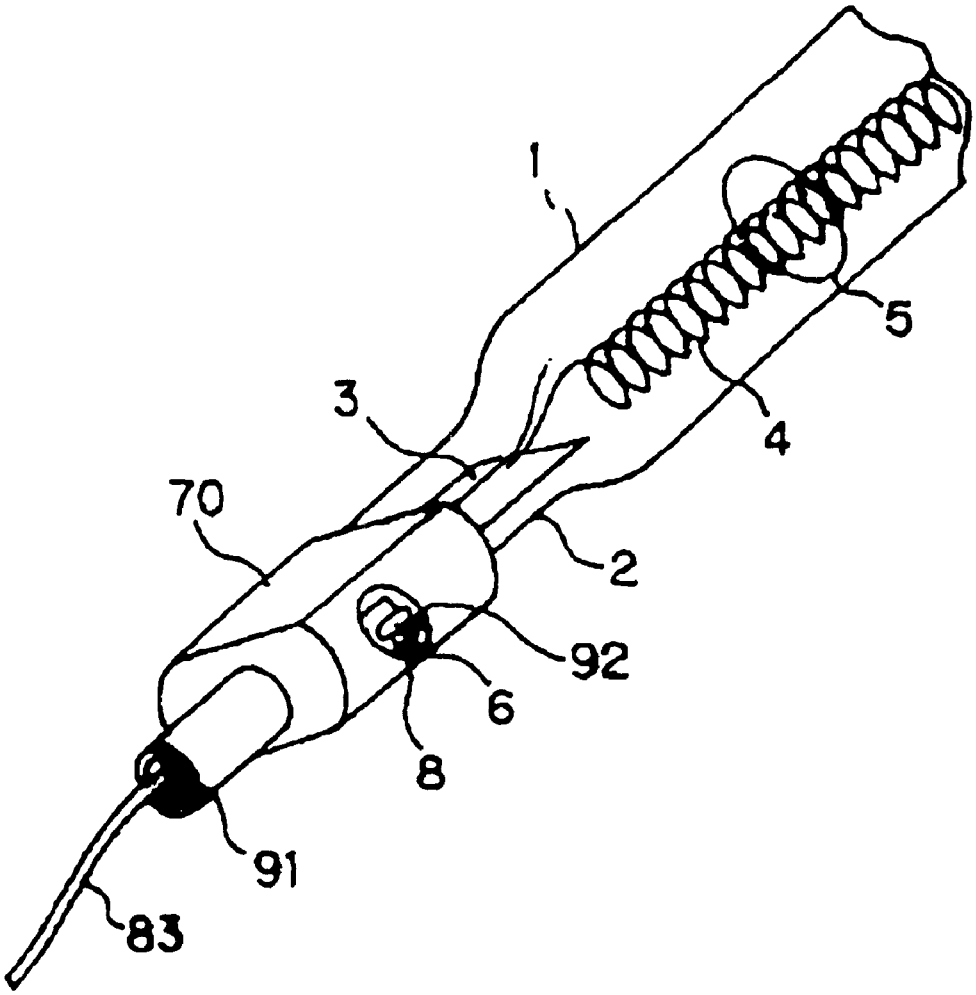
FIG. 6 PRIOR ART
FIG. 6 is a perspective of one end of a conventional filament lamp with bases.
Figure 7:
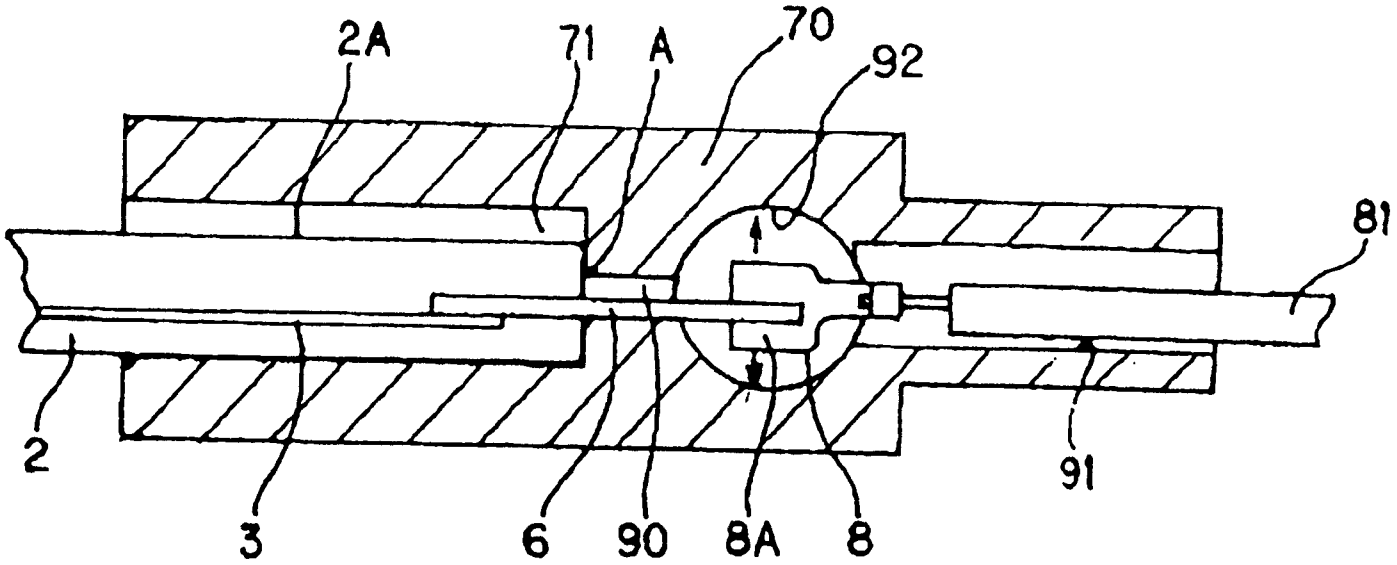
FIG. 7 PRIOR ART
FIG. 7 is a cross-sectional view of the end of the filament lamp with bases as shown in FIG. 6 taken in a plane which is perpendicular the lengthwise direction of the through opening.

FIG. 5 shows the shape of the pinch seal area 2 which is held in the holding part 71. The height D3 is 3.2 mm and the width D4 is 11.0 mm. This means that the holding part 71 has essentially the same shape as that of the pinch seal area 2 which is held, but is slightly larger.

The flat plane 8A of the plate-shaped terminal 8, which is guided to the through opening 92, runs parallel to the wider crimped foot surface 2A of the pinch seal area 2. The outer lead 6 and the plate-shaped terminal 8 are brought into contact with one another in this state and are welded to one another. Welding is performed at the location at which the terminal 8 and the outer lead 6 are in contact with one another in that, from the two directions of the through opening 92, which is formed in the direction which orthogonally intersects the lengthwise direction of the base 70 and which orthogonally intersects the wider crimped foot surface 2A of the pinch seal area 2 which is held in the holding part 71, a welding rod (not shown) is inserted. Since the terminal 8 is larger than the first opening 90 it does not fall out of the first opening 90. As a result thereof, the wider crimped foot surface 2A of the pinch seal area 2 and the flat plane 8A of the plate-shaped terminal 8 are welded to one another in a parallel state relative to one another. Thus, the base 70 is attached in the pinch seal area 2.

Figure 3:
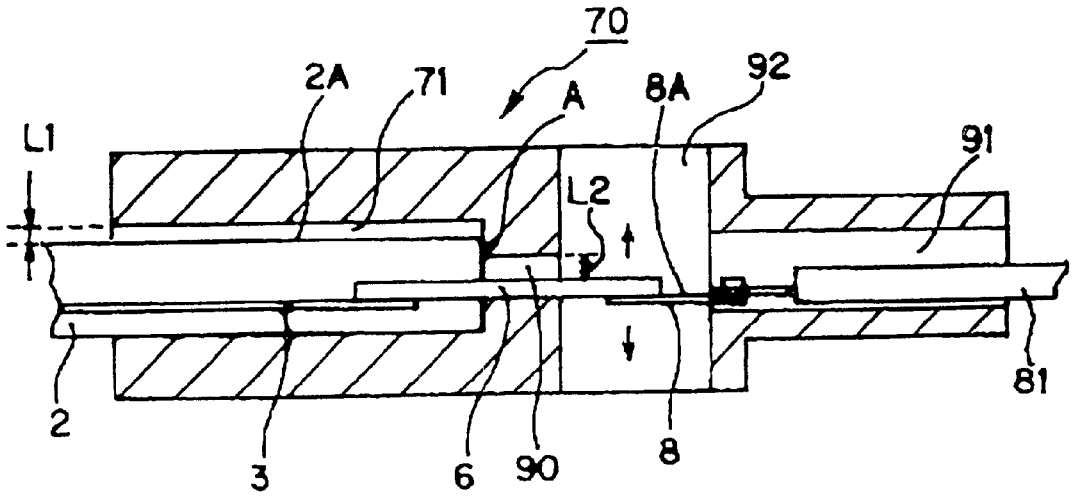
FIG. 3 is a cross section of the end of the filament lamp with bases according to FIG. 1 taken in a plane which is parallel to the lengthwise direction of the through opening.

The plate-shaped terminal 8 bends and it can absorb a stress even if the terminal 8 is exposed to a stress in the directions of the arrows in FIG. 3. The terminal 8 thus can absorb a stress in the direction which orthogonally intersects the wider crimped foot surface 2A, i.e., a stress in the direction in which the pinch seal area 2 often breaks. In this way, the stress which transfers to the outer lead 6 can be largely reduced and damage to the pinch seal area 2 is prevented.

Furthermore, the holding part 71 essentially has the same shape as the pinch seal area 2, as was described above. As is shown in FIG. 3, the distance L1 between the wider crimped foot surface 2A which is one side of the pinch seal area 2, and the inside of the holding part 71 is, for example, 0.4 mm and the distance L2 between the outer lead 6 and the peripheral edge area A of the first opening 90 is, for example, 1.0 mm. Since the distance L1 is therefore less than the distance L2, the wider crimped foot surface 2A borders the inside of the holding part 71 even if the pinch seal area 2 is tilted within the holding part 71. This can prevent the outer lead 6 from contacting the peripheral edge area A of the first opening 90. The outer lead 6 is thus not exposed to a stress and damage to the pinch seal area 2 is prevented.

What we claim is:

1. Filament lamp with bases, comprising:

a tubular bulb with a pinch seal area formed on each end, the pinch seal area being flattened so as to form a wide crimped foot surface;

a filament which is located within the bulb along a longitudinal axis of the tubular bulb;

outer leads, each of which is electrically connected at an inner end to a respective end of the filament and projects out of respective pinch seal area;

plate-shaped terminals, each of which electrically connects an outer end of a respective one of the outer leads to a feed line; and bases made of a ceramic material for protection of the plate-shaped terminals;

wherein each ceramic base has a concave holding part on one side for holding of the respective pinch seal area and a first opening into which the respective outer lead is inserted, and on an opposite side, has a second opening into which the respective plate-shaped terminal is inserted;

wherein a through opening is located between the first opening and the second opening for enabling the outer lead and the plate-shaped terminal to be welded to one another in a direction which orthogonally intersects a lengthwise direction of the base and orthogonally intersects the wide crimped foot surface of the pinch seal area in the holding part; and wherein the respective plate-shaped terminal has a flat planar surface which is larger than the first opening of the base and is welded to the outer lead with a flat plane thereof parallel to the wide crimped foot surface of the pinch seal area.

2. Filament lamp with bases as claimed in claim 1, wherein the holding part of the respective base has essentially the same shape as that of the pinch seal area received therein; and wherein a distance between a side of the pinch seal area from which the outer lead does not project, and a facing inner side of the holding part is smaller than a distance between the outer lead, which penetrates the first opening of the base, and a peripheral edge area of the first opening.

* * * * *